United States Patent [19]

Graul

[11] 4,311,979

[45] Jan. 19, 1982

[54] LAYERED TRANSFORMER WINDING

[75] Inventor: Otto Graul, Bamberg, Fed. Rep. of Germany

[73] Assignee: Messwandler-Bau GmbH, Bamberg, Fed. Rep. of Germany

[21] Appl. No.: 57,283

[22] Filed: Jul. 13, 1979

[30] Foreign Application Priority Data

Jul. 13, 1978 [DE] Fed. Rep. of Germany ..... 2830757

[51] Int. Cl.[3] ..... H01F 27/28

[52] U.S. Cl. ..... 336/205; 29/605; 174/119 R; 336/206; 336/223; 336/228

[58] Field of Search ..... 174/117 FF, 119 R; 336/225, 96, 205, 206, 223, 232, 228; 29/605

[56] References Cited

U.S. PATENT DOCUMENTS

| | | | |
|---|---|---|---|
| 753,461 | 3/1904 | Anderson | 336/206 |
| 2,577,707 | 12/1951 | Kerns et al. | 336/206 X |
| 3,246,271 | 4/1966 | Ford | 336/206 |
| 3,265,998 | 8/1966 | Park | 336/96 X |
| 3,427,578 | 2/1969 | Gray et al. | 336/206 |

FOREIGN PATENT DOCUMENTS

| | | | |
|---|---|---|---|
| 66588 | 9/1913 | Switzerland | 174/117 FF |
| 346944 | 7/1960 | Switzerland | 336/225 |

*Primary Examiner*—Thomas J. Kozma
*Attorney, Agent, or Firm*—Craig and Antonelli

[57] ABSTRACT

A transformer winding, made as a layered winding with striplike conductor insulated with at least one strip of insulation folded about the conductor, and a process for making the same, are disclosed. To make possible a fully automatic manufacture of the winding with sufficient mechanical strength and uniform impregnation, the insulation strip, in addition to insulation of the conductor, constitutes likewise the insulation of the layers. At the periphery of a winding layer there are punctate bonding places at predetermined distances only on the outside of the conductor insulation. The cross section of the layered winding may be essentially trapezoidal with the transition to the free outer end comprising one or more circular arcs with different radii.

9 Claims, 9 Drawing Figures

FIG.1
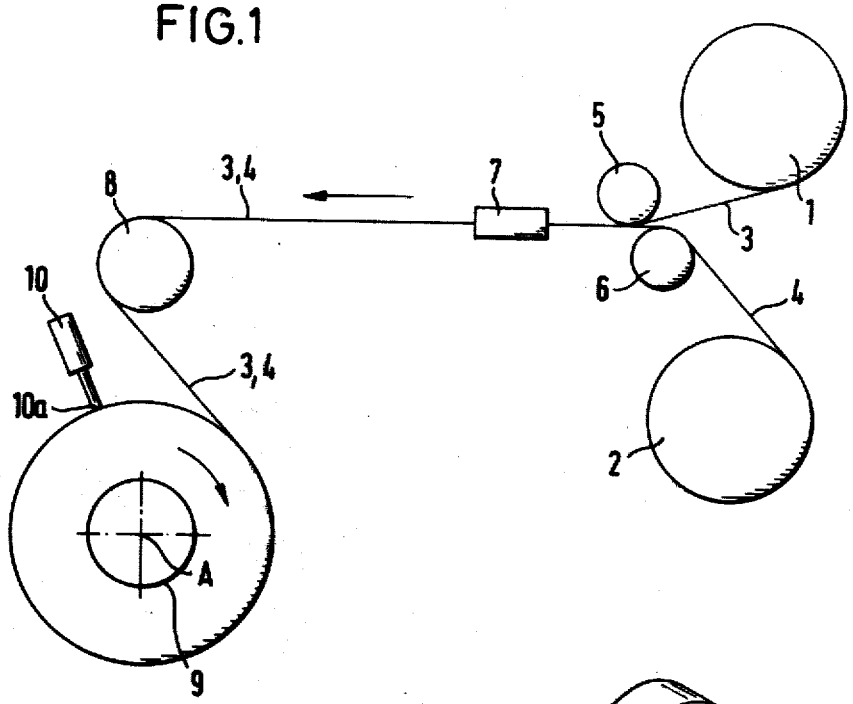
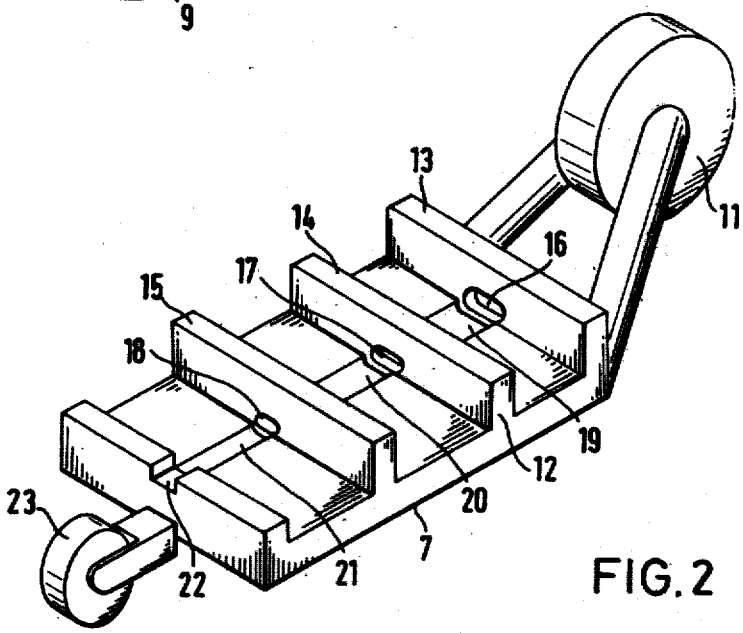
FIG.2

LAYERED TRANSFORMER WINDING

BACKGROUND AND SUMMARY OF THE INVENTION

The present invention relates to a layered winding, advantageously a high voltage layered winding, for a transformer with striplike conductor insulated with at least one strip of insulation folded about the conductor. Such insulation can be applied in the course of the layered winding of the conductor with a strip of insulation that corresponds to about three times the width of the conductor, so that the insulation strip can be folded double about the conductor.

A process for insulation of striplike conductors for choke or transformer coins of the described type is known, for example, from German Offenlegungsschrift No. 15 63 458. It is a disadvantage in this known process that adhesive is supplied for fastening of the conductor insulation and at the same time of the individual paper layers respectively upstream of the folding devices. This admittedly leads to an adequate bonding of the paper insulation that is folded about the conductor, but fastening of the winding layers is only guaranteed if the adhesive material is applied to the insulation paper in excess so that part of the adhesive will soak through the folding joints and thereby allow bonding of the corresponding winding of the next layer. Such a process is not suitable, to impart the necessary mechanical strength to a layered winding that comprises a plurality of layers, especially a high voltage layered winding. Also exact impregnation is difficult because the bonding places are largely undefined, between the individual layers.

The present invention is concerned with the problem of so improving a transformer winding of the mentioned type, made as a layered winding, advantageously a high voltage layered winding, that the mechanical strength will be adequate even with a large number of layers. Also, impregnation is not to be hampered by measures taken for fastening the individual winding layers. Especially however, the present invention concerns a fully automatic, preferably program-controlled winding technique.

This problem is solved according to the present invention in that the insulation strip in addition to the conductor insulation forms at the same time the insulation of the layers. Along the periphery of a winding layer, at specific distances, punctate bonding places are located only on the outside of the layer insulation, serving for fixation of the next succeeding winding layer. Further, according to the present invention, the length of the winding layers is so shortened from layer to layer that the cross section of the layered winding is trapezoidal at first or at least essentially trapezoidal, while the transition to the free outer end of the layered winding comprises one or more circular arcs with different radii.

It is important for the fully automatic winding process that the conductor insulation forms the layer insulation at the same time. This eliminates the tedious winding in or shooting in of the layer insulation, which has made the manufacture of known layered windings difficult and expensive. It is also favorable that the punctate bonding places disposed on the outside of the conductor insulation yields an outstanding fixation of the individual winding layers, and therewith a compact winding structure. At the same time, the remaining gaps between the bonding places allow adequate impregnation with liquid or gaseous impregnating materials. It is also favorable that because of the arcuate transition from the trapezoid or essentially trapezoid part of the winding to the free outer end of the layered winding, the shielding electrode on a high voltage potential can be made very simply. By the selected winding structure, an excellent layer control is obtained.

There is a further advantage according to the present invention if the individual windings of a layer formed by the striplike conductor together with its insulation border on each other at the front with no spacing between them. The use of striplike conductors with a width that is substantially greater than the thickness makes possible the winding of layer on layer without any space between, without the layer tension thereby becoming excessive, despite the lack of a supplementary layer insulation. Also, the impregnation with liquid or gaseous impregnants requires no frontal separation of the individual windings of a layer. On the other hand, gaps caused in manufacture which amount to fractions of a millimeter, between the individual fronts of the windings are not disturbing and can even promote the process of impregnation.

According to an additional feature of the present invention the layered winding is essentially trapezoidal in cross section but with the free fronts of the layered winding beginning like an e-function and then going over into a linear part to which then the circular terminal arc is connected as shown in FIG. 4*a*. Also, an immediate transition from a side surface curved like an e-function into the circular terminal arc is possible as depicted in FIG. 4*b*.

The invention further relates to a process for the production of a transformer winding, advantageously a high voltage layered winding with striplike conductor whose insulation is applied in the course of the layered winding of the conductor using an insulation strip which is folded about the conductor. In particular, the insulation strip may have a width about three times the width of the conductor so that the insulation strip can be folded double about the conductor. This process is characterized in that the folding of the insulation strip about the striplike conductor is undertaken in several stages, that the insulated conductor is guided over a deflector roll in such a way that the conductor part running onto the deflector roll and the conductor part running off the deflector roll describe a sharp angle and that the strip insulation of adjacent layers is bonded at punctate bonding places spaced at predetermined distances. In one preferred process a bonding material is applied to the outside of the winding of a layer shortly before overlaying the new winding of the adjacent layer.

The folding of the insulation strip about the striplike conductor in several stages makes possible the use of a folding device that is comparatively simple to produce. The deflection of the insulated striplike conductor via the deflector roll has the effect that the insulating material firmly encloses the conductor, so that bonding of overlapping parts of the insulation strip can be eliminated.

These and other objects, features and advantages of the present invention will become more apparent from the following description when taken in connection with the accompanying drawings, which show, for purposes of illustration only, several embodiments in accordance with the present invention.

BRIEF DESCRIPTION OF THE DRAWINGS

FIG. 1 is a sketch showing the principle for production of a layered winding according to the invention that can be made of striplike conductive material;

FIG. 2 is a perspective view of a multistage folding device for application of the insulation;

DETAILED DESCRIPTION OF THE DRAWINGS

Figure 3:
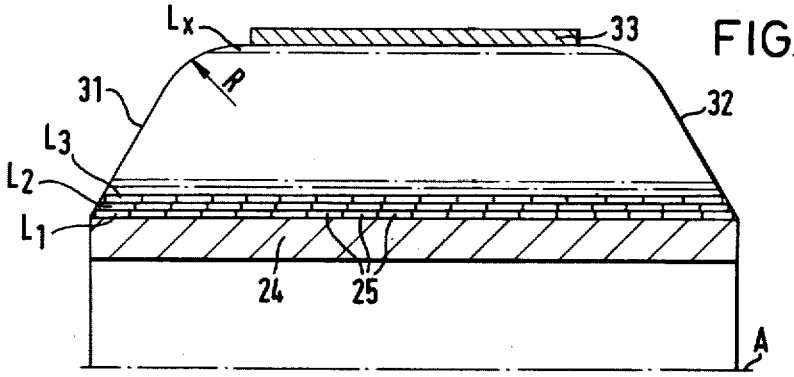
FIG. 3 is a cross section through a layered winding according to the invention.

FIG. 1 shows the two reserve rolls 1, 2 for the striplike conductor 3, which is advantageously aluminum, and for insulation strip 4 that is to be wound about conductor 3. Insulation strip 4, depending upon the impregnant, can be plastic foil or organic materials such as cable paper or the like. Appropriate impregnating materials are especially oil or gas, preferably sulfur hexafluoride. Conductor 3 and insulating strip 4 are supplied via intake rolls 5 and 6 to a multistage folding device 7. Folding device 7 together with the downstream deflector roll 8 has the effect that insulation strip 4 whose width is about three times the width of the conductor will enclose conductor 3 from winding tension. Deflector roll 8 is disposed more or less perpendicularly above the winding axis A of winder 9 so that the insulated conductor part 3, 4 running toward deflector roll 8 and insulated conductor part 3, 4 running off the deflector roll 8 will describe a sharp angle, between 40° and 70°. Firm jacketing of conductor 3 by insulation strip 4 is promoted by this association of deflector roll 8 and winder 9. In the winding on direction, just before the place at which insulated conductor part 3, 4 runs tangentially onto the already present winding layer, there is at least one conventional bonding device 10 with which a plurality of bonding points 10*a* of adhesive, for example, can be periodically applied on the outside of the already present insulation of the winding of an earlier winding layer, distributed over the periphery of a winding and spaced at predetermined distances. Advantageously there can be provision of three to seven bonding points along the periphery of a winding, to obtain a compact winding structure.

FIG. 2 shows the structure and operation of the multistage folding device 7. This comprises an articulatedly borne intake roll 11 to which, as FIG. 1 shows, the striplike conductor 3 and the insulation strip 4 are delivered together. A base plate 12 is provided with several transverse supports 13, 14, 15 with continuously diminishing passage openings 16, 17, 18 for the insulated conductor part 3, 4. There are also continuously diminishing guide grooves 19, 20, 21 in base plate 12, which promote the enclosing of insulation strip 4 about conductor 3. The conductor, completely jacketed with insulation material, issues from folding device 7 via an exit groove 22 and an exit roll 23.

FIGS. 3 and 4*a* to 4*c* show the winder of the illustrated layered winding: the winder is designated by numeral 24, and the axis of the winding is designated by the letter A. The individual windings 25 are only surrounded by insulation strip 4, as shown in FIG. 5*a*. There is no layer insulation between layers $L_1$, $L_2$, $L_3$ . . . $L_x$.

Winding insulation 4 of conductor 3 is such that the outer surface of the conductor 26 with reference to winding axis A has twice the insulation strip 28, 29 as compared to the inside 27 of the conductor (insulation strip 30).

Since the ratio B/D of conductor width/conductor thickness is relatively large, i.e. 50:1 to 100:1, the width of insulation strip 4 is at least almost three times the width B of striplike conductor 3. Conductor thickness D can practically be disregarded.

The layered winding of FIG. 3 is made as a known trapezoidal winding whose lateral surfaces 31, 32 however go over into pronounced arcs with radius R in the final layers. The outermost winding layer $L_x$, about over its part that runs cylindrically is surrounded by a slit metal band that forms an annular electrode 33.

Figure 4A:
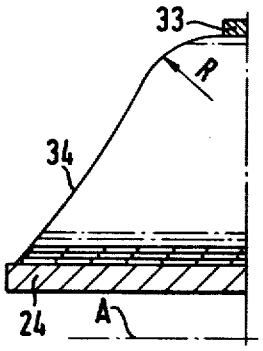
FIGS. 4*a*, 4*b* and 4*c* show modifications of the layered winding according to FIG. 3, FIGS. 5*a* and 5*b* show cross sections on an enlarged scale, through the striplike conductor with one or two insulation strips folded double.
Figure 4B:
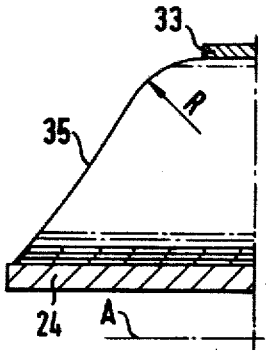
Figure 4C:
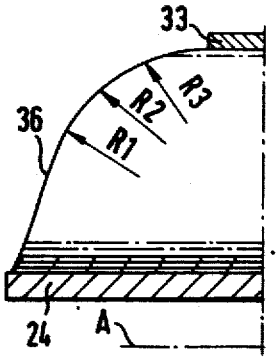
Figure 5A:
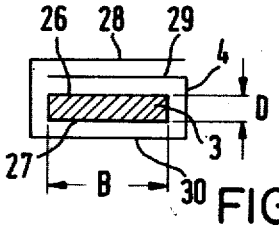

As FIGS. 4*a*–4*c* show, the layered winding according to the invention may also present a profile that deviates somewhat from the trapezoidal form.

Thus lateral face 34 can run first like an e-function and then go over into a linear part before the arcuate part with radius R leads over to the final winding layers as shown in FIG. 4*a*.

According to the embodiment of FIG. 4*b*, the lateral face 35 can also be so formed that the winding part running as an e-function will go over directly into the arcuate part with radius R.

FIG. 4*c* shows an embodiment in which the lateral face 36 first runs precisely in trapezoidal form, whereby then an arcuate part with decreasing radii $R_1$, $R_2$, $R_3$ is connected.

Figure 5B:
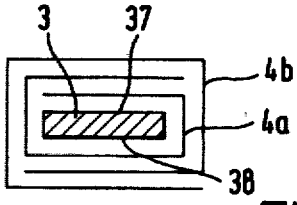

As FIG. 5*b* shows, the insulation of the striplike conductor 3 can also be formed by two insulator strips 4*a*, 4*b* which are folded on the one hand on outer side 37 (with reference to axis A) and on the other hand about the inside conductor surface 38.

Figure 6:
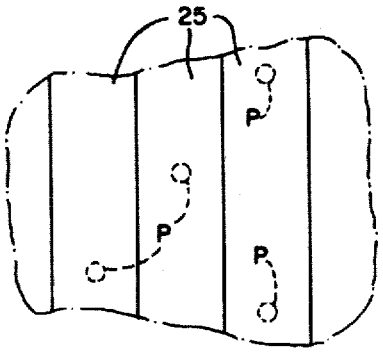
FIG. 6 shows a side view of a portion of a layered winding schematically illustrating the punctate bonding places.

To increase the mechanical strength of the layered winding according to the invention, particularly in case of rather large numbers of layers, it can be advantageous to apply the bonding points p from winding to winding at different places on the winding periphery as illustrated schematically in FIG. 6.

The radii that determine the arcuate transitions to the free outer end of the layered winding advantageously are from 20 to 100 mm.

Layered windings made according to the invention are suitable for all sorts of transformers, particularly measuring and testing transformers, advantageously for inductive voltage converters. One of the main fields of application is that of $SF_6$ insulated inductive voltage converters.

The layered winding according to the invention makes possible a substantial rationalizing of the manufacturing process because the whole insulating and winding process, from the first winding of the first layer to the last winding of the last layer can be fully automated by appropriate program control.

While I have shown and described only several embodiments in accordance with the present invention, it is understood that the same is not limited thereto but is susceptible of numerous changes and modifications as would be known to those skilled in the art, given the present disclosure, I therefore do not wish to be limited to the details shown and described herein but intend to cover all such changes and modifications as are encompassed by the scope of the appended claims.

I claim:

1. A transformer winding comprising a plurality of winding layers made with a striplike conductor insulated with at least one strip of insulation folded about the conductor in the course of the layered winding of the conductor, said at least one strip of insulation having a width of about three times the width of said conductor and extending around the conductor in at least one layer, said strip insulation not only serving to insulate said conductor but also forming the insulation between adjacent layers of winding without insertion of layer insulations, adjacent winding layers of said winding being affixed to one another at punctate bonding places spaced at predetermined distances by means of a plurality of bonding points of adhesive which are applied along the periphery of a winding layer only on the outside of the conductor insulation and which serve for a fixation of the next succeeding winding layer, and the winding layers being so shortened that the winding is essentially trapezoidal in cross section with the transition to the free outer end of the winding being formed with at least one circular arc, whereby said transformer winding can be produced by a fully automatic, program-controlled winding technique.

2. The transformer winding according to claim 1, wherein said transition comprises a plurality of circular arcs with different radii.

3. The transformer winding according to claim 1, wherein said winding is formed by winding said striplike conductor together with its insulation about a winding axis and wherein said insulation strip is folded about said conductor in such a way that the outer side of the conductor surface with reference to the winding axis has twice as much insulation strip as the inner side of the conductor surface.

4. The transformer winding according to claim 1, wherein individual windings formed by the striplike conductor together with its insulation, of a layer of said transformer winding, border against each other at their edges without any spacing.

5. The transformer winding according to claim 1, wherein the insulation of the striplike conductor is formed by two insulation strips that are folded about the conductor.

6. The transformer winding according to claim 5, wherein said insulation strips are sufficiently wide that they can be folded double about one of the wide surfaces of the conductor, and wherein one strip is folded double about an outer conductor surface, with reference to a winding axis, and the second strip is folded double about the inner conductor surface.

7. The transformer winding according to claim 1, wherein the winding layers are so shortened that, as viewed in cross section, starting from the inner end of the layered winding, the front faces of the said windings first present the configuration of an e-function, to which there is adjoined a linear trapezoidal part of the layered winding.

8. The transformer winding according to claim 1, wherein the winding layers are so shortened that, as viewed in cross section, starting from the inner end of the layered winding the front faces of the layered winding first present the configuration of an e-function to which there is immediately joined at least one circular arc as transition to the free outer end of the layered winding.

9. The transformer winding according to claim 3, 4, 5 or 6, wherein a slit metal band is positioned adjacent the outermost winding layer to form an electrode.

* * * * *